United States Patent [19]

Coles et al.

[11] Patent Number: 4,547,164

[45] Date of Patent: Oct. 15, 1985

[54] SHIP DECK LIFELINE

[75] Inventors: Russell I. Coles, Philadelphia, Pa.; Norman J. Griest, Rockville, Md.; Raoul J. Marando, Kent, Wash.; Aaron A. Suleske, Stafford, Va.

[73] Assignee: The United States of America as represented by the Secretary of the Navy, Washington, D.C.

[21] Appl. No.: 577,437

[22] Filed: Feb. 6, 1984

[51] Int. Cl.[4] ..... B63C 9/00; H01B 17/60

[52] U.S. Cl. ..... 441/84; 343/709; 174/185

[58] Field of Search ..... 441/84, 85; 114/103, 114/109, 111, 364; 174/2, 5 R, 178, 180, 183, 185, 138 D, 158 R, 208, 43, 45 R, 158 F, 160, 161 R, 161 F, 170; 59/93, 95; 248/66; 343/709, 710; 191/39, 40

[56] References Cited

U.S. PATENT DOCUMENTS

| | | | |
|---|---|---|---|
| 717,322 | 12/1902 | Barry | 174/185 |
| 728,015 | 5/1902 | Robb | 174/180 |
| 735,611 | 8/1903 | Steinberger | 174/180 |
| 742,098 | 10/1903 | Proudfit | 174/180 |
| 826,589 | 7/1906 | Meirowsky | 174/180 |
| 834,392 | 10/1906 | Mead | 174/185 |
| 1,068,144 | 7/1913 | Lawler | 174/180 |
| 1,098,250 | 5/1914 | Gonia | 174/180 |
| 1,959,982 | 5/1934 | Loeser | 361/217 |
| 2,967,903 | 1/1961 | Mageoch | 174/180 |
| 3,804,973 | 4/1974 | Koch | 74/208 |
| 4,291,639 | 9/1981 | Burdick | 114/39.1 |
| 4,313,236 | 2/1982 | Tupper et al. | 441/84 |

FOREIGN PATENT DOCUMENTS

| | | | |
|---|---|---|---|
| 304885 | 1/1933 | Italy | 174/180 |

*Primary Examiner*—Trygve M. Blix
*Assistant Examiner*—Edwin L. Swinehart
*Attorney, Agent, or Firm*—Robert F. Beers; Henry Hansen; Vincent T. Pace

[57] ABSTRACT

A ship deck lifeline has an insulator fitting interposed between the metal cable and the metal end stanchion. The lifeline cable is insulated from the metal ship deck thereby reducing electrical interference with the ship's electronic instrumentation. The insulator fitting is designed to be easily retrofit to existing lifelines.

3 Claims, 4 Drawing Figures

SHIP DECK LIFELINE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates generally to metallic lifelines in use on naval vessels and more particularly to a lifeline which reduces electromagnetic interference with shipboard electronic instruments.

The lifelines or safety lines in use on naval ships comprise wire ropes which are secured to metal posts or stanchions mounted on the metal decks of the ship. Naval ships carry many sophisticated and sensitive electronic instruments, and such lifelines have created serious problems in that they contribute to the electromagnetic interference (EMI) problem aboard ship which hinders and disrupts the operation of the electronic instruments.

SUMMARY OF THE INVENTION

It is an object of the present invention to reduce electromagnetic interference with shipboard electronic instrumentation due to metallic ship deck lifelines.

Another object of this invention is to provide a metallic lifeline which is electrically insulated from the metal deck of a ship.

A further object of this invention is to provide a means for easily retrofitting existing ship deck lifelines to be insulated from the metal ship deck.

The above and other objects are realized in the present invention which provides a ship deck lifeline in which an insulating device is connected between the wire ropes and the metal stanchions. The insulating device includes two connectors which are non-rotatably secured in a metal body. An insulating bushing insulates one connector from the metal body and an insulating disk insulates the connectors from each other.

Other objects, advantages and novel features of the invention will become apparent from the detailed description of the invention which follows the accompanying drawings wherein:

DESCRIPTION OF THE PREFERRED EMBODIMENT

Figure 1:
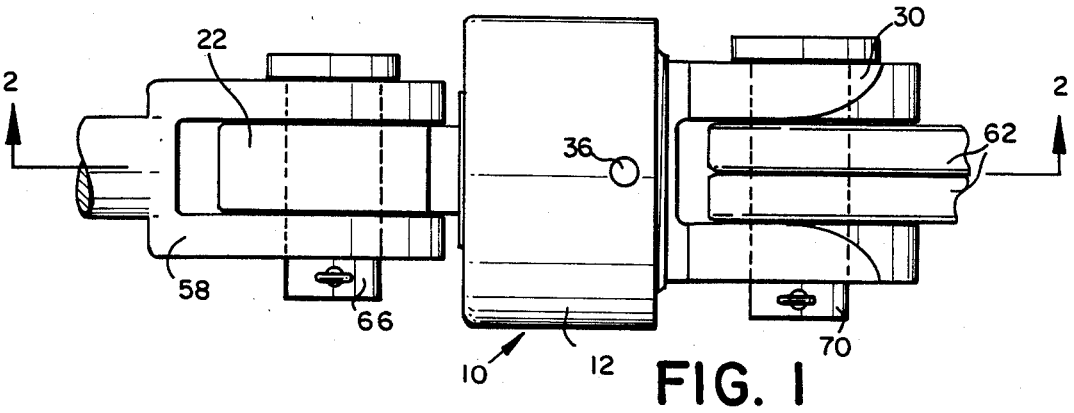
FIG. 1 is a plan view of an insulator fitting as used in the present invention also showing parts of external fittings connected thereto.

Referring now to the drawings wherein like reference numerals designate identical or corresponding parts among the several views, and more particularly to FIG. 1, there is shown generally an insulator fitting 10 as used in the present invention.

Figure 2:
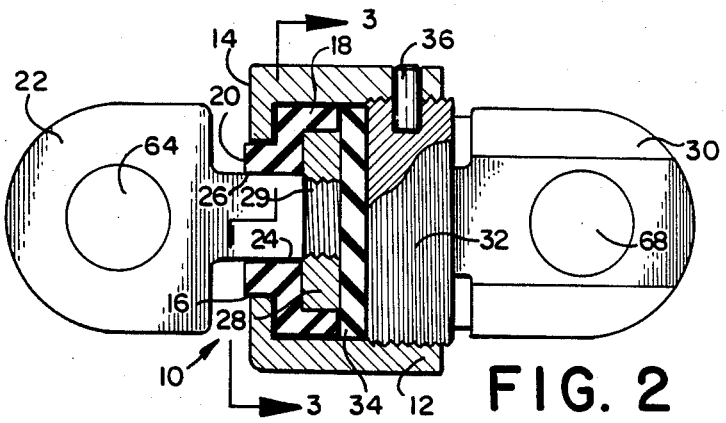
FIG. 2 is a sectional view of the insulator fitting as viewed along line 2—2 of FIG. 1 without the external fittings.
Figure 3:
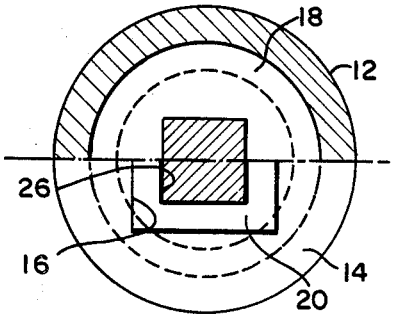
FIG. 3 is a cross-sectional view of the insulator fitting of FIG. 2 as viewed along line 3—3.

Insulator fitting 10 has a cup-shaped metal housing or body 12. As shown in FIG. 2 housing 12 has an end wall 14 which is provided with a square central opening 16. A bushing 18 of electrical insulating material fits within metal housing 12 adjacent to end wall 14. Bushing 18 has a square boss portion 20 which fits within opening 16. A clevis eye 22 has a square shank 24 which fits within and extends through a square opening 26 in boss portion 20 of insulator bushing 18. This relationship is shown more clearly in FIG. 3.

The opposite or open end of housing 12 is internally threaded and a clevis 30 having a threaded shank 32 is screwed therein. An insulator disk 34, which is of the same material as bushing 18, is interposed between the inner end of shank 32 of clevis 30 and the inner end of shank 24 of eye 22. Insulator disk 34 is preferably in abutment with retainer plate 22 and the inner side of insulator bushing 18. Thus, when clevis 30 is tightly screwed into housing 12, all of the parts are securely clamped therein, and clevis 30 is electrically isolated from clevis eye 22. A locking pin 36 may be driven through the housing 12 into the threaded shank 32 of clevis 30 to knock it in place.

Prior to assembly of each insulator fitting 10, an RTV silicone compound, for example Dow Corning 721, is applied to the interior of housing 12. As the fitting is assembled, the RTV is forced to fill the interstices between housing 12, insulator bushing 18, eye shank 24, and clevis shank 32 to prevent moisture from reaching the internals of insulator fitting 10.

Figure 4:
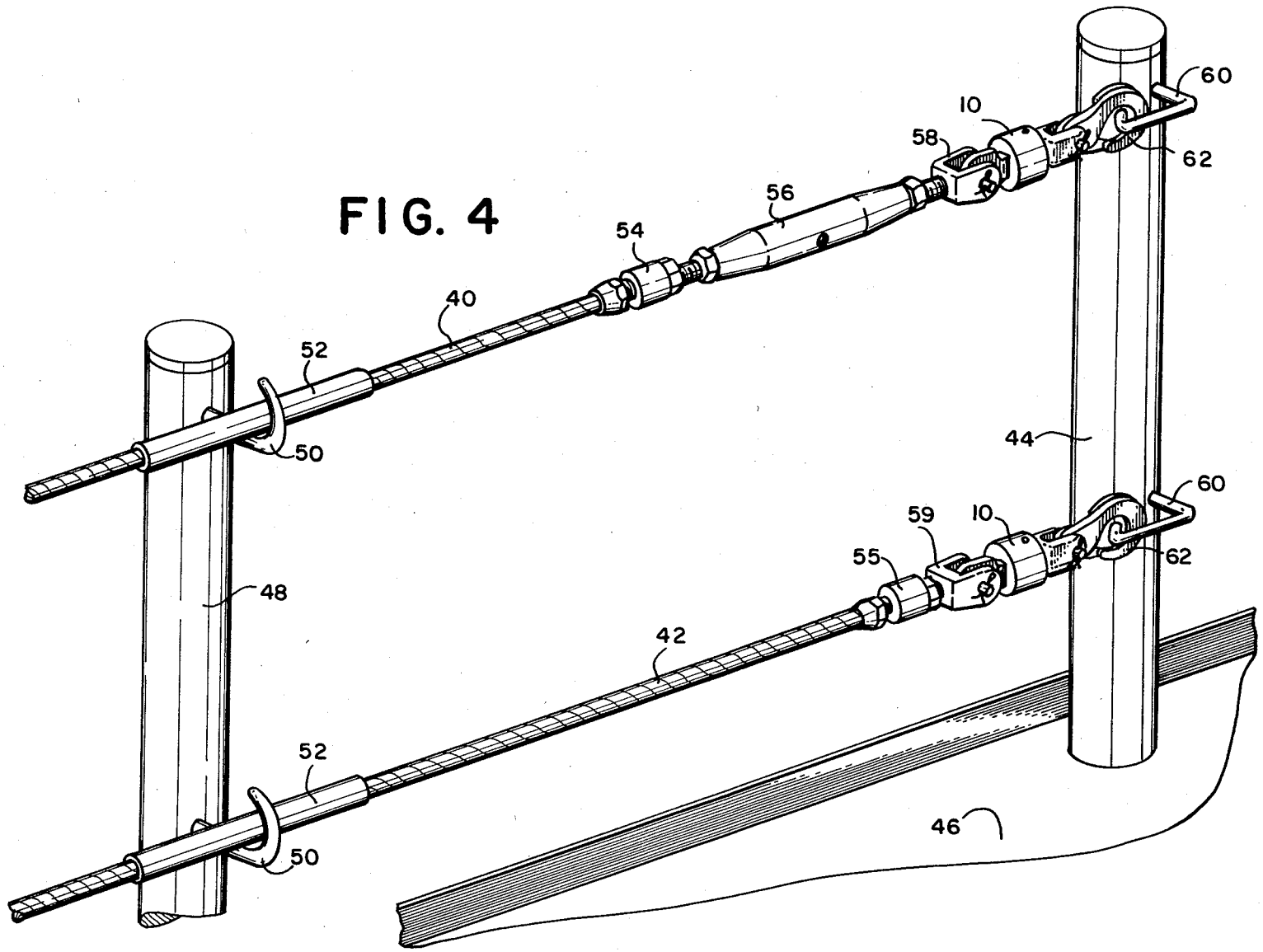
FIG. 4 is a perspective view of a typical lifeline installation on the deck of a ship which shows the installation of insulator fittings according to the present invention.

Referring now to FIG. 4, there are shown two lifelines comprising wire rope cables indicated as 40 and 42. These cables are secured at their ends to an end stanchion 44. Additional lifelines, although not shown, may be used. Cables 40 and 42 are supported on intermediate stanchions such as 48, by hooks 50 engaging sleeves 52 of insulating material encasing cables 40 and 42.

Cables 40 and 42 have conventional end fittings 54. Cable 40 has a turnbuckle 56 attached to end fitting 54 with a clevis 58 connected to its other end. However, clevis 59 is directly attached to end fitting 55, as shown on cable 42.

Insulator fittings 10 are shown connected on one end to clevis's 58 and 59, and connected on the other end to rings 60 on stanchion 44 by pairs of so-called sister hooks 62. As shown in FIGS. 1 and 2, clevis eye 22 is provided with a hole 64 for receiving a pivot pin 66 to connect eye 22 to a clevis 58. The tongues of clevis 30 are likewise provided with aligned holes 68 to receive a pivot pin 70 about which the sister hooks 62 pivot.

Installation of the insulator fitting on an existing lifeline on a ship is fairly simple. The pivot pin, such as pin 66 in clevis 58, which normally connects the clevis 58 to the sister hooks 62, is removed and inserted in hole 64 of eye 22 to connect it to clevis 58. The sister hooks 62 are then connected by pin 70 to the clevis 30 of insulator fitting 10 and attached to ring 60 of the stanchion 44.

Some of the many advantages and new features of the subject invention should now be apparent in view of the foregoing description. For example, a ship deck lifeline has been described which has an electrical insulator interposed between the metal lifeline cable and the end stanchions. The metal cable is insulated from the stanchion and metal deck, thereby reducing electromagnetic interference problems on a vessel equipped with sensitive electronic instrumentation.

Numerous additional modifications and variations of the subject invention are possible in light of the above teachings. It is therefore to be understood that within the scope of the appended claims, the invention may be practiced otherwise than as specifically described herein.

What is claimed is:

1. A ship deck lifeline for reducing electromagnetic interference with shipboard electronic equipment, comprising in combination:

a plurality of metal stanchions fastened to the ship's deck, said stanchions including end stanchions and intermediate stanchions disposed at spaced intervals between said end stanchions;

a plurality of metal cables formed for horizontal suspension from the end stanchions and supported by the intermediate stanchions;

electrical insulators connected between each end of said cables and respective ones of said end stanchions; and electrical insulating sleeves fixed to said cables at said spaced intervals for slidably engaging said intermediate stanchions.

2. A ship deck lifeline as recited in claim 1 wherein said insulators each comprise:

a metallic housing;

a first connector secured in one end of said housing and connected to an end fitting on said cable;

a square bushing non-rotatably secured in said housing for insulating said first connector from said housing;

a second connector secured in the other end of said housing for connection to the end-stanchion; and an insulating disk disposed in said housing between said first and second connectors such that said connectors are electrically insulated from each other.

3. A ship deck lifeline as recited in claim 2 wherein:

said metallic housing has a square opening in the end adjacent to said first connector;

said first connector comprises a square shank portion; and said insulating bushing comprises a square boss portion formed to fit within the opening in said metallic housing, said square boss portion itself having a square opening for receiving said square shank portion of said first connector, whereby said first connector is non-rotatably secured to said metallic housing.

* * * * *